US010381187B1

(12) United States Patent
Moody et al.

(10) Patent No.: US 10,381,187 B1
(45) Date of Patent: Aug. 13, 2019

(54) ELECTRON PHOTOEMISSION WITH TUNABLE EXCITATION AND TRANSPORT ENERGETICS

(71) Applicant: Los Alamos National Security, LLC, Los Alamos, NM (US)

(72) Inventors: Nathan Andrew Moody, Los Alamos, NM (US); Mark Arles Hoffbauer, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 31 days.

(21) Appl. No.: 15/675,607

(22) Filed: Aug. 11, 2017

(51) Int. Cl.

| | |
|---|---|
| ***H01J 40/06*** | (2006.01) |
| ***H01J 29/04*** | (2006.01) |
| ***H01J 9/12*** | (2006.01) |
| ***H01J 29/89*** | (2006.01) |

(52) U.S. Cl.
CPC ..... *H01J 29/04* (2013.01); *H01J 9/12* (2013.01); *H01J 29/89* (2013.01); *H01J 2229/8926* (2013.01)

(58) Field of Classification Search
None
See application file for complete search history.

(56) References Cited

U.S. PATENT DOCUMENTS 3,672,992 A * 6/1972 Schaefer ..... H01J 9/12 148/DIG. 119
4,644,221 A * 2/1987 Gutierrez ..... H01J 1/34 313/373
8,888,914 B2 * 11/2014 Nihashi ..... C30B 29/403 117/101
2006/0170324 A1 * 8/2006 Machuca ..... H01J 1/34 313/364

OTHER PUBLICATIONS

Miller et al., Low-temperature grown compositionally graded InGan films, Phys. stat. sol. (c)6, No. 6, pp. 1866-1869 (2008).
Jensen et al., Delayed Photo-Emission Model for ea Optics Code, Los Alamos National Security, Los Alamos, NM, 14 pp. (2016).

* cited by examiner

*Primary Examiner* — Vip Patel
(74) *Attorney, Agent, or Firm* — Lewis Roca Rothgerber Christle LLP

(57) ABSTRACT

A photocathode for use in vacuum electronic devices has a bandgap gradient across the thickness (or depth) of the photocathode between the emitting surface and the opposing surface. This bandgap gradient compensates for depth-dependent variations in transport energetics. When the bandgap energy $E_{BG}(z)$ is increased for electrons with shorter path lengths to the emitting surface and decreased for electrons with longer path lengths to the emitting surface, such that the sum of $E_{BG}(z)$ and the scattering energy is substantially constant or similar for electrons photoexcited at all locations within the photocathode, the energies of the emitted electrons may be more similar (have less variability), and the emittance of the electron beam may be desirably decreased. The photocathode may be formed of a III-V semiconductor such as InGaN or an oxide semiconductor such as GaInO.

16 Claims, 4 Drawing Sheets

ELECTRON PHOTOEMISSION WITH TUNABLE EXCITATION AND TRANSPORT ENERGETICS

STATEMENT REGARDING FEDERALLY SPONSORED RESEARCH OR DEVELOPMENT

The United States government has certain rights in this invention pursuant to Contract No. DE-AC52-06NA25396 between the United States Department of Energy and Los Alamos National Security, LLC for the operation of Los Alamos National Laboratory.

CROSS-REFERENCE TO RELATED APPLICATION(S)

This application may be related to U.S. Provisional Patent Application Ser. No. 62/415,457, filed on Oct. 21, 2016 and titled "TUNABLE QUANTUM CONFINEMENT AND QUANTUM DOT PHOTOCATHODE".

BACKGROUND

High performance vacuum electronic applications such as X-ray free electron lasers (FELs) require electron beams having high brightness, high peak current densities, low transverse and/or longitudinal emittances, prompt response times, and long shelf and operational lifetimes. The desire for further advances in fields using such X-ray light sources motivates development of photocathode electron sources that are better able to meet all of these specifications.

SUMMARY

According to embodiments of the present disclosure, a photocathode has an emitting surface and an opposing surface opposite the emitting surface, the emitting surface and the opposing surface being separated from each other by a depth of the photocathode. The photocathode includes a material having a bandgap gradient in which the bandgap is configured to vary according to position within the depth of the photocathode, such that the bandgap gradient compensates for depth-dependent differences in transport energetics.

In some embodiments, the bandgap gradient increases from the opposing surface to the emitting surface.

In some embodiments, the material having the bandgap gradient comprises a stoichiometry gradient that varies according to position within the depth of the photocathode, and the stoichiometry gradient dictates the bandgap gradient.

In some embodiments, the material having the bandgap gradient is a III-V semiconductor material. In some embodiments, the material having the bandgap gradient is an oxide semiconductor material.

In some embodiments, the material having the bandgap gradient is a ternary semiconductor material comprising a first element, a second element, and a third element; the first element having a constant concentration throughout the material; the second element having a concentration higher than that of the third element at the emitting surface; and the third element having a concentration higher than that of the second element at the opposing surface.

In some embodiments, the material having the bandgap gradient substantially includes the first element and the second element at the emitting surface, and substantially includes the first element and the third element at the opposing surface.

In some embodiments, at least one of the first, second, and third elements is located in an interstitial position.

In some embodiments, the material is InGaN, GaInSb, or GaInAs. In some embodiments, the material is InGaN. In some embodiments, the material is GaInO.

In some embodiments, the material having the bandgap gradient has a grain size as large as a thickness of the photocathode.

In some embodiments, the bandgap gradient has a resolution of about 0.5 nm to about 1.5 nm.

According to embodiments of the present disclosure, a method of fabricating the photocathode includes: computing a transport energetics profile for the photocathode; computing a complementary bandgap profile based on the transport energetics profile; and depositing a composition to create the material having the bandgap gradient according to the complementary bandgap profile.

According to embodiments of the present disclosure, a vacuum electronic device includes: the photocathode; an anode; and a light source, wherein the photocathode and anode are configured to be under vacuum and the light source is directed toward the photocathode.

According to embodiments of the present disclosure, a method of generating a low-emittance electron beam includes: computing a transport energetics profile for a photocathode comprising a material having a bandgap gradient; computing a complementary bandgap profile based on the transport energetics profile; depositing a composition to create the photocathode according to the complementary bandgap profile; combining the photocathode with an anode under a high vacuum environment; biasing the photocathode toward a negative voltage; and irradiating the photocathode with a light source.

BRIEF DESCRIPTION OF THE DRAWINGS

These and other features and advantages of embodiments of the present invention will be better understood by reference to the following detailed description when considered in conjunction with the accompanying drawings, in which.

bandgaps of these benchmark materials. The circle markers correspond to regions of the $In_{1-x}Ga_xN$ material having a larger fraction of In, while the square markers correspond to regions of the $In_{1-x}Ga_xN$ material having a larger fraction of Ga.

DETAILED DESCRIPTION

Figure 1:
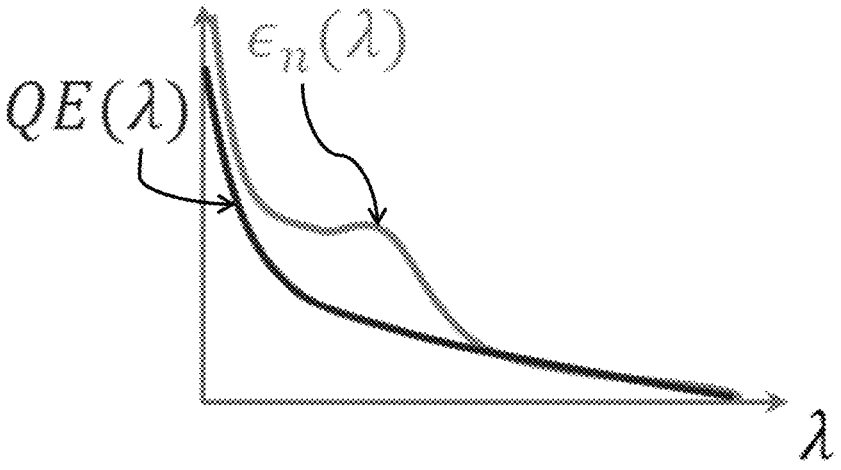
FIG. 1 is a graph illustrating the general relationship between quantum efficiency (QE) and emittance ($\varepsilon_n$) as a function of the wavelength of light ($\lambda$) used to stimulate photoemission in a conventional photocathode.

According to embodiments of the present disclosure, a semiconductor photocathode produces an electron beam with high quantum yield and low emittance. In some embodiments, a vacuum electronic device includes the semiconductor photocathode. According to some embodiments, a method of producing an electron beam uses the semiconductor photocathode.

A photocathode is a negatively charged electrode that emits electrons only upon illumination with light (e.g., emits photoexcited electrons). Photocathodes are of interest for use in vacuum electronic devices (such as particle accelerators, X-ray sources, electron microscopes, etc.) that emit radiation in the form of a coherent electron beam.

In such vacuum electronic devices, it is desirable to be able to time-gate, or pulse the electron beam (e.g., turn the electron beam on and off) on very short timescales. Vacuum electronic devices in the related art have used cathodes that rely on thermionic (thermally induced) electron emission to produce an electron beam. The temperature transitions associated with initiation and quenching of such thermionic emission (either on its own or by building up an opposing electric field) occur on relatively long timescales; thus, the use of thermionic vacuum electronic devices in time-gating applications has been limited. In contrast, cathodes that rely on photoexcited electron emission can be quickly turned on and off (e.g., pulsed) along with the flux of incident exciting photons. Indeed, vacuum electronic devices using photocathodes can time-gate on picosecond timescales.

The performance of electron beams generated by such photocathodes can be characterized according to various figures of merit, which include quantum efficiency (QE), emittance, responsiveness to incident pulsed light (e.g., response time), operational lifetime, and environmental stability (e.g., ruggedness or lack of sensitivity to the water and oxygen in the environment).

Due to the dual wave-particle nature of electromagnetic radiation and light, it will be understood that although various descriptions of light herein may refer to light as "a wave", "a photon", etc., such terms may be used interchangeably, and the utilization of any of these terms does not exclude the other terms, or models and formalisms using those terms.

As used herein, the term "quantum efficiency" ("QE") is used in its art-recognized sense to refer to the efficiency with which photons are converted into free electrons, and may be calculated as the ratio of the number of emitted electrons (e.g., current) to the number of incident photons per $cm^2s$. The QE is dependent on the wavelength or energy of the photons, and may be expressed as a function of either. In the ideal case when all incident photons are converted into free electrons, the QE is 1. However, energy losses due to, for example, electron scattering, frequently result in QEs less than 1. The QE determines the peak and average current for a given laser intensity and duration. In general, higher QEs result in high peak and average currents and are therefore desirable.

As used herein, the term "emittance" is used in its art-recognized sense to describe the degree or amount of spatial spread in the electron beam as it propagates. For instance, emittance is a measure of the average spread in the position and momentum of the emitted electrons, and may be expressed in dimensions of length or length times angle. Beam emittance can also be thought of as a measure of entropy. A beam having a lower emittance value tends to have a smaller cross-sectional area, with its electrons being more uniform in momentum. In general, lower emittance values, indicating smaller spreads in electron position and momentum, are desirable. In addition, lower emittance is correlated with higher brightness.

The responsiveness (response time) of the electron beam is a measure of how quickly the electron beam can be toggled on and off (e.g., time-gated) in response to photons incident on the photocathode, as described above. In general, faster response times are desirable.

The operational lifetime of the electron beam is a measure of how long the photocathode can be used before it needs to be replaced. In general, longer operational lifetimes are desirable.

The ruggedness of the electron beam describes the sensitivity of the photocathode to the vacuum device environment. A more rugged (insensitive) beam can be used under a larger range of conditions and in the presence of higher concentrations of vacuum contaminants such as oxygen and water. In general, more rugged cathodes are desirable.

The five photocathode characteristics described above are linked in various ways. As such, simultaneous optimization of two or more characteristics may not be practical, and/or may require undesirable tradeoffs. FIG. 1 is a graph illustrating the general relationship between QE and emittance ($\varepsilon_n$) as a function of the wavelength of light ($\lambda$) used to stimulate photoemission in a conventional photocathode. As shown in FIG. 1, at shorter wavelengths and higher photon energies (e.g., toward the left side of the x-axis), QE increases because the average energy of photoexcited electrons increases, such that a larger proportion or number of electrons are able to overcome energy losses due to scattering. However, emittance simultaneously increases, in part because the increased photon penetration depth (which is a function of the shorter wavelength, or alternatively the increased photon energy) causes electrons to be generated within a wider range of distances (depths) from the surface of the photocathode. Energy losses proportional to the depth at which the electrons are generated cause electrons along the depth of the photocathode to be emitted with a wide range of energies, resulting in increased beam emittance. As such, there is a direct tradeoff between QE and emittance in photocathodes of the related art. However, desirable electron beams generally have high QE and low emittance values.

The characteristics of photocathodes are additionally dependent on the materials used in the photocathodes. For example, photocathodes formed of metal generally exhibit fast response times due to their short laser penetration depth and low work function, which is the result of electron-electron (e-e) scattering. However, the high rate of electron scattering also reduces the number of emitted electrons, and as such, the QEs of metal-based photocathodes are low.

As another example, photocathodes formed of bulk semiconductors exhibit relatively improved QEs compared to metal photocathodes due to their deeper laser penetration depths and electronic structures that promote electron-phonon (e-p) scattering instead of e-e scattering, which is comparatively less detrimental to electron emission rates. However, such bulk semiconductor photocathodes also exhibit dramatically lengthened response times because electrons are produced deeper within the photocathode, and thus require extra time to travel to the emitting surface of the photocathode for emission.

As used herein, the term "bulk" is used in its art-recognized sense to describe a volume or amount of material that does not exhibit quantum confinement effects, and therefore exhibits properties that are substantially uniform and substantially identical to the properties that would be exhibited in an infinite amount of the same material. A bulk material may have a grain size larger than a nanoparticle (e.g., an average diameter larger than about 100 nm).

As used herein, the terms "substantially" and "generally" are used as terms of approximation and not as terms of degree, and are intended to account for the inherent inaccuracies in measured, observed, or calculated values or qualities, as well as normal variations and deviations in the measurement or assessment of various parameters and characteristics (e.g., in the description of physical or chemical properties of various photocathode materials and compositions).

Figure 2:
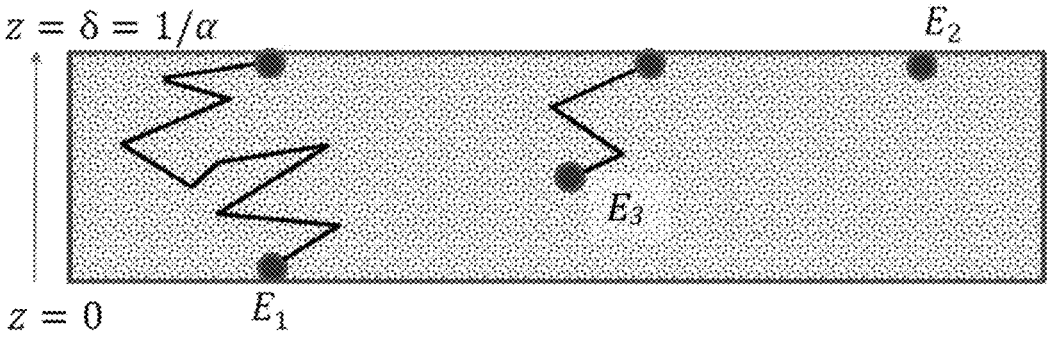
FIG. 2 is a schematic diagram illustrating the physical basis for emittance in a semiconductor photocathode having a finite thickness $\delta$. The photocathode is oriented so that the thickness $\delta$ is parallel to the z axis, the bottom (rear or opposing) face of the photocathode is at z=0, and the top (emitting) face of the photocathode is at z=$\delta$. The circles $E_1$, $E_2$, and $E_3$ correspond to electrons generated at different z coordinates upon light penetration and photoexcitation throughout the thickness of the photocathode.

FIG. 2 is a schematic diagram illustrating the physical basis for emittance in a semiconductor photocathode having a finite thickness δ. In FIG. 2, the photocathode is oriented so that the thickness δ is parallel to the z axis, the bottom (rear or opposing) face (or surface) of the photocathode is at z=0, and the top (emitting) face (or surface) of the photocathode is at z=δ. The circles $E_1$, $E_2$, and $E_3$ correspond to electrons generated at different depths of the photocathode (i.e., different z coordinates) upon light penetration and photoexcitation throughout the thickness of the photocathode. Specifically, $E_1$ shows an electron generated at a depth of z=0 (the rear face of the cathode), which must then traverse the entire depth (or thickness) of the photocathode before it can be emitted in an electron beam. $E_2$ shows an electron generated at a depth of z=δ (the emitting surface of the cathode), which does not need to traverse the photocathode before being emitted in an electron beam. Finally, $E_3$ shows an electron generated at an arbitrary depth of $0<z<\delta$ within the photocathode, which must traverse a portion of the depth of the photocathode (i.e., an intermediate distance to the emitting surface compared to the other two electrons $E_1$ and $E_2$). The black lines shown in connection with the $E_1$ and $E_3$ electrons depict the "random walk" path traversed by these electrons from the time and position of initial generation to the time and point of emission at the emitting surface of the photocathode. The "random walk" path traversed by each generated electron is dictated by the number and intensity of scattering events the electron encounters during its travel from the point of initial generation to the point of emission at the emitting surface. These scattering events can generally be described as collisions or interactions of the electron with other components in the photocathode (such as, e.g., phonons or the lattice ion core) which cause a change in the direction of the electron's path with respect to the emitting surface. Each of these scattering events causes the electron to lose energy.

Electron photoemission occurs in three steps according to the Moments-based model of photoemission: (1) absorption of incident light to generate a photoexcited electron within the photocathode; (2) transport of the photoexcited electron to the emitting surface; and (3) transmission of the photoexcited electron through the potential barrier at the emitting surface of the material to thereby produce a free electron. A photoexcited electron must have a non-zero energy at the emitting face of the photocathode in order to be emitted as or within an electron beam. Assuming conservation of energy, the initial energy of a photoexcited electron should be equivalent to that of the incident photon. However, some or all of that energy may be expended or lost due to one or more mechanisms during the steps of electron photoemission outlined above.

The energies of the electrons $E_1$ (i.e., the electron generated at or near the opposing or rear surface of the photocathode) and $E_2$ (i.e., the electron generated at or near the emitting surface of the photocathode) at the emitting face of the photocathode can be expressed by Equations 1 and 2, respectively:

$$E_1=\hbar\omega-\Delta_1-(E_{BG}(z)+E_{aff}) \quad \text{Equation 1}$$

$$E_2=\hbar\omega-\Delta_2-(E_{BG}(z)+E_{aff}) \quad \text{Equation 2}$$

In Equations 1 and 2, ħw refers to the energy of the photon used to stimulate electron generation during Step 1. $\Delta_1$ and $\Delta_2$ refer to energy losses arising from collisions of the generated electrons during their path to the emitting surface during Step 2. $\Delta_1$ and $\Delta_2$ can be alternately envisioned as the integral sum of energy losses over all electron scattering events (such as interactions between the electron and phonons or the lattice ion core) occurring during Step 2. $E_{BG}(z)$ and $E_{aff}$ refer to the bandgap energy ($E_{BG}(z)$) and the electron affinity ($E_{BG}(z)$), respectively, which are the energy costs required to excite the electron across the semiconductor bandgap (e.g., from the valence band to the conduction band) in Step 1, and then to a free electron (e.g., to vacuum) in Step 3.

The energy losses associated with the electron scattering events that the electrons undergo during transport to the emitting surface may be referred to as the electron's transport energetics. The energy losses associated with electron excitation across the bandgap may be referred to as the electron's excitation energetics.

In a conventional semiconductor photocathode, upon initial electron excitation, ħw, $E_{BG}(z)$, and $E_{aff}$ should be substantially the same for all photoexcited electrons, regardless of their position within the photocathode. The term "substantially" in this context is used as a term of approximation and not as a term of degree, and is intended to reflect the difficulty in achieving exact measurements or calculations of these terms. However, because the number of electron scattering events experienced by an electron prior to photoemission is proportional to the path length traveled by the electron within the photocathode, the value of $\Delta_n$ (n=1, 2, 3 . . . ) (e.g., the transport energetics) varies between electrons generated at different depths within the photocathode (i.e., electrons generated at different z coordinates in FIG. 2). Accordingly, a conventional semiconductor photocathode will generate electrons having a range of energies. As such, conventional semiconductors typically generate electron beams having non-zero emittance.

The range of energies of the generated electrons (and thereby the emittance of the electron beam) may be decreased or adjusted by narrowing the range of depths at which electrons are generated within the photocathode (i.e., by narrowing the range of z coordinates at which electrons are generated in the photocathode). This narrowing of the range of depths may be accomplished either by decreasing the thickness (or depth) of the photocathode or by reducing the energy and penetration depth of the incident photons that generate the electrons. However, such a decrease in the effective thickness (or depth) of the photocathode would also result in a decrease in the number of emitted electrons, thereby decreasing the current and/or QE. Therefore, the quality of electron beams generated by conventional bulk semiconductor photocathodes (in terms of, e.g., emittance and QE) has been limited.

According to embodiments of the present disclosure, however, a semiconductor photocathode has tunable excitation and transport energetics. As used herein, the term "tunable" refers to the ability to vary or tailor the identified property or characteristic to achieve a particular goal or result. For example, "tunable" excitation refers to the ability to vary or tailor the bandgap of the semiconductor material of the photocathode in order to yield a particular electron excitation energy or range of electron excitation energies within the photocathode. In some embodiments, the bandgap of the photocathode material may be tuned as a function of the coordinate or position within the depth or thickness of the photocathode at which electrons are generated (e.g., the z-coordinate within the photocathode at which the electron is generated). In some embodiments, the bandgap of the photocathode material may be tuned in order to achieve excitation energetics that counterbalance or compensate for variations in the transport energetics of different electrons generated in the photocathode (e.g., electrons generated at different depths or thicknesses within the photocathode).

Tunable excitation may alternatively be referred to herein as "graded excitation" to reflect tuning of the bandgap of the photocathode material to create a gradient along the depth (or thickness) of the photocathode. As used herein, the term "counterbalance" in the context of counterbalancing variations in the transport energetics refers to the selection of excitation energetics (e.g., energy values) so that their sum remains constant. For example, the photocathode may be designed or tuned so that electrons that are excited or generated in regions requiring a relatively high amount of energy for transport to the emitting surface experience relatively low bandgap excitation energies, and vice versa (i.e., electrons excited or generated in regions requiring relatively low amounts of energy for transport to the emitting surface experience relatively high bandgap excitation energies). The terms "counterbalance", "compensate for", and "complement" may be interchangeably used in this respect. This compensation enables electrons generated at different excitation energies (e.g., at different depths within the photocathode) to reach the emitting surface of the photocathode with relatively uniform energies. These photocathodes (i.e., that generate electrons at the emitting surface with generally or substantially uniform energies at the emitting surface), in turn, generate electron beams of improved and superior quality. For example, the electron beams generated by photocathodes according to the present invention can exhibit high QE as well as low emittance.

According to embodiments of the present disclosure, a photocathode for vacuum electronic applications has an emitting surface and an opposing surface (or rear surface) opposite the emitting surface and separated from the emitting surface by a depth (or thickness) of the photocathode. The photocathode includes a material having a band gap gradient, in which the band gap is configured to vary according to position within the depth (or thickness) of the photocathode. This bandgap gradient compensates for depth-dependent differences in transport energetics.

The term "having a bandgap" is used in its art-recognized sense to refer to a material or substance having an electronic structure in which the allowable energy levels (states) available to electrons within the material do not span a single continuous range of energies; rather, the electronic structure includes at least one "gap" that does not include any allowable energy levels or bands. The term "bandgap gradient" refers to a graded variation (e.g., a gradual increase or decrease) in the energy associated with the bandgap across the thickness or depth of the photocathode. As used herein and unless stated otherwise, references to "a bandgap" or "the bandgap" refer to the bandgap closest in energy to the Fermi level of a material, as is standard in the art. The term "Fermi level" is used in its art-recognized sense to refer to the hypothetical energy level that has a 50% probability of being occupied at thermodynamic equilibrium. In a semiconductor material, the Fermi level lies within or close to the edge of an occupied energy band. The position and width of the bandgap (i.e., with respect to energy level) and the electronic structure of the semiconductor material are not limited to being constant throughout the semiconductor material (e.g., are not limited to being the same for any two points within the material), and may substantially vary.

In some embodiments, the bandgap may be configured (e.g., tuned) so that the bandgap gradient increases from the opposing surface to the emitting surface. For example, the photocathode may have a smaller bandgap at the opposing surface than at the emitting surface, and therefore a larger bandgap at the emitting surface than at the opposing surface. In such embodiments, the bandgap gradient may involve a graded increase in the bandgap of the photocathode material from the opposing surface to the emitting surface; or stated in the opposite, the bandgap gradient may involve a graded decrease in the bandgap of the photocathode material from the opposing surface to the emitting surface. Alternatively, in some embodiments, the photocathode may have a larger bandgap at the opposing surface than at the emitting surface, and therefore a smaller bandgap at the emitting surface than at the opposing surface. In such embodiments, the bandgap gradient may involve a graded decrease in the bandgap of the photocathode material from the opposing surface to the emitting surface; or, stated in the opposite, the bandgap gradient may involve a graded increase from the emitting surface to the opposing surface. Here, the terms "smaller" and "larger" bandgap are used to reference each other, i.e., to note that one bandgap is larger or smaller than the other, and are not used to denote or imply a particular numerical value.

From another perspective, the thickness (or depth) of the photocathode may be defined as the vector substantially perpendicular to the emitting and opposing surfaces of the photocathode, with the origin of the vector being set as the geometric center of the opposing surface of the photocathode. According to embodiments of the present disclosure, the bandgap of the photocathode may be tuned to include a graded decrease (or a graded increase) with increasing distance along the vector, thereby forming a bandgap gradient along the vector.

The graded increase or decrease of the bandgap gradient is not particularly limited and may include any suitable number of "grades" or different bandgaps. For example, considering the photocathode material as a series of "bandgap layers" with each layer representing a different bandgap, the photocathode may include any suitable number of bandgap layers. As used herein, the term "different bandgap" may refer to bandgaps that are distinguishable by energy differences of, for example, at least 0.1 eV. However, embodiments of the present disclosure are not limited thereto, and those having ordinary skill in the art are capable of determining the scale of suitably distinguishable energy differences according to the state of the art and the principles described herein. In some embodiments, for example, the bandgap gradient may include at least two different bandgaps, for example at least three or more, at least four or more, or at least five or more different bandgaps. It is understood also, that while reference is made here to "bandgap layers," neither the photocathode nor the bandgap gradient is necessarily separated into discrete layers of materials or bandgaps. Instead, in some embodiments, the bandgap of the photocathode material can vary gradually enough that the photocathode material and structure is considered continuous. In some embodiments, however, the photocathode material may be considered a collection of discrete layers, each having a different bandgap, thereby creating a graded (and layered) bandgap structure.

As discussed herein in connection with Equations 1 and 2, each photoexcited electron starts with the same energy $\hbar w$ and loses at least a portion of that energy to scattering $\Delta_n$, the bandgap energy $E_{BG}(z)$, and the electron affinity $E_{aff}$. The quantities $\hbar w$ and $E_{aff}$ are substantially the same for all electrons, while $\Delta_n$ is proportional to the length of the path traveled by the individual electron through the photocathode to the emitting surface (prior to being emitted). Accordingly, increasing the $E_{BG}(z)$ for electrons with shorter path lengths and decreasing the $E_{BG}(z)$ for electrons with longer path lengths results in the sum of $E_{BG}(z)+\Delta_n$ being substantially constant or similar for electrons photoexcited at different locations within the photocathode. This, in turn, results in the energies of the emitted electrons being more similar (having less variability), and the emittance of the resulting electron beam may therefore be desirably decreased.

From another perspective, when the bandgap energy $E_{BG}(z)$ is exactly (or closely) matched with the energy requirement $\Delta_n$ for achieving successful transport to the emitting surface in each photoexcited electron, excess energy in the electrons closer to the emitting surface may be eliminated or reduced, and beam emittance may therefore be improved.

Figure 3:
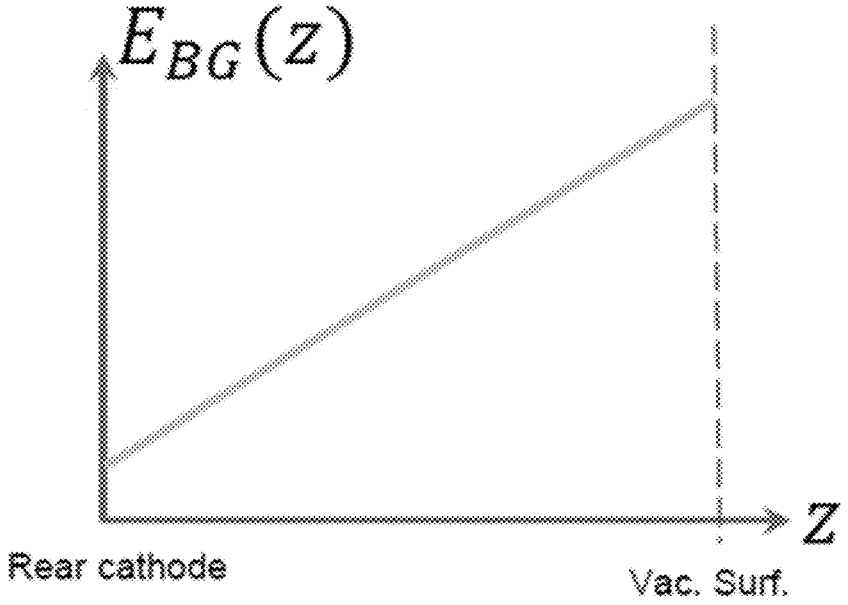
FIG. 3 is a graph showing the bandgap energy ($E_{BG}(z)$, y-axis) of the photocathode of FIG. 2 as a function of position (z) between the opposing surface ("rear cathode") and the emitting surface ("Vac. Surf.") when the photocathode is configured according to an example embodiment of the present disclosure.

FIG. 3 is a graph showing the bandgap energy ($E_{BG}(z)$, y-axis) of the photocathode of FIG. 2 as a function of position (z) between the opposing surface ("rear cathode") and the emitting surface ("Vac. Surf.") when the photocathode is configured according to an example embodiment of the present disclosure. Although FIG. 3 depicts a linear relationship (gradient) between $E_{BG}(z)$ and z, embodiments of the present disclosure are not limited thereto. In some embodiments, the function $E_{BG}(z)$ may be approximated as a higher order polynomial, an exponential function, a log function, a power function, or a convolution of two or more such functions. Indeed, the shape, curvature, or slope(s) of the function $E_{BG}(z)$ will depend on the characteristics of the photocathode material, for example, the scattering behavior of that material. In general, however, $E_{BG}(z)$ should be a monotonically increasing function.

In some embodiments, the bandgap is a direct bandgap. However, embodiments of the present disclosure are not limited thereto, and in some embodiments, the bandgap is an indirect bandgap.

In some embodiments, the variation in bandgap throughout the photocathode may be correlated with and determined by variations in material composition throughout the photocathode. Indeed, from another perspective, according to embodiments of the present disclosure a photocathode includes an emitting surface and an opposing surface opposite the emitting surface and separated from the emitting surface by a depth (or thickness) of the photocathode. The photocathode includes a material having a bandgap gradient, and the stoichiometry of the material having the band gap may be varied according to the position within the depth (or thickness) of the photocathode. For example, although the photocathode material may include the same semiconductor elements (e.g., In, Ga and N in an InGaN photocathode material), the relative proportions of those elements (e.g., In, Ga and N) may be different at different depths of the photocathode structure. These differences in stoichiometry result in differences in the bandgap of the photocathode material. Stated differently, while the photocathode includes the same elemental make-up (e.g., In, Ga and N in an InGaN material), the bandgap of the material may be tuned by changing the relative proportions of each of the elements. To create the bandgap gradient, therefore, the stoichiometry of the photocathode material varies (e.g., over a gradient along the coordinate between the emitting surface and the opposing surface). This stoichiometry gradient generally correlates with the bandgap gradient, i.e., in some embodiments, the stoichiometry variations dictate the bandgap of the material at different depths of the photocathode, and therefore the stoichiometry gradient dictates the bandgap gradient.

Although various photocathode materials may have compositions that are referred to or named as single chemical formulae (e.g., InGaN), it is understood that the single formula (e.g., InGaN) does not necessarily imply uniformity of composition throughout the photocathode material. Rather, the composition may encompass spatial variations therein, and the term "single chemical formula" only denotes the inclusion of the listed elements (in the case where coefficients are not specified) (e.g., In, Ga and N), or the average composition (in the case where coefficients are provided), unless specifically stated otherwise.

The photocathode material (e.g., the material having the bandgap gradient) may be a material or composition that includes at least two elements (e.g., a binary material or composition), or for example, at least three elements (e.g., a ternary material or composition). In some embodiments, the photocathode material may be composed of three elements (e.g., a ternary composition or material).

The composition of the photocathode material may include a stoichiometry gradient which may be tuned (or tailored) to provide the desired bandgap gradient (or profile). The stoichiometry gradient may include a gradient in the concentration of one or more of the constituent elements of the photocathode material composition. For example, the concentration or stoichiometry of one or more of the constituent elements may decrease with increasing proximity to the opposing surface, and increase with increasing proximity to the emitting surface. Alternatively, the concentration or stoichiometry of one or more of the constituent elements may decrease with increasing proximity to the emitting surface, and increase with increasing proximity to the opposing surface. As used herein, "increasing" concentration (or stoichiometry) refers to an increase in the concentration of the respective constituent element relative to another one or more of the constituent elements in the empirical formula of the photocathode material, or relative to the composition as a whole. Conversely, as used here, "decreasing" concentration (or stoichiometry) refer to a decrease in the concentration of the respective constituent element relative to another one or more of the constituent elements in the empirical formula, or relative to the composition as a whole.

In creating the stoichiometry gradient, in some embodiments, the concentration or stoichiometry of one or more of the constituent elements may remain constant across the entire gradient (e.g., have a uniform concentration) and throughout the photocathode. In these embodiments, the other constituent elements of the photocathode composition are used to create the stoichiometry gradient, as discussed above. For example, in a binary composition, according to embodiments of the present disclosure, one of the two elements remains constant across the entire stoichiometry gradient, while the concentration of the other element is varied to create the gradient. Similarly, in ternary and larger composition systems, in some embodiments, one of the three (or more) elements remains constant across the entire gradient, while at least one of the other two or more elements is varied to create the gradient. For example, in these larger component photocathode composition systems, only one of the other two or more (i.e., the three or more elements less the one element that remains constant in these example embodiments) elements may be varied to create the stoichiometry gradient, or two or more of the remaining elements may be varied. In embodiments in which two or more elements are varied to create the stoichiometry gradient, the two or more elements may be varied simultaneously or in sequence, as discussed further below.

Similar to the term "bandgap gradient" discussed above, the term "stoichiometry gradient" refers to a graded variation (e.g., a gradual increase or decrease) in the concentration or one or more elements in the empirical formula of the photocathode material across the thickness or depth of the photocathode. As discussed generally above, the stoichiometry gradient may involve a graded increase in the concentration of one or more elements of the photocathode material from the opposing surface to the emitting surface; or stated in the opposite, the stoichiometry gradient may involve a graded decrease in the concentration of the one or more elements of the photocathode material from the opposing surface to the emitting surface. Alternatively, in some embodiments, the photocathode may have a larger concentration of the varied element(s) at the opposing surface than at the emitting surface, and therefore a lower concentration of that element at the emitting surface than at the opposing surface. In such embodiments, the stoichiometry gradient may involve a graded decrease in the concentration of the varied element(s) of the photocathode material from the opposing surface to the emitting surface; or, stated in the opposite, the stoichiometry gradient may involve a graded increase from the emitting surface to the opposing surface.

Like the bandgap gradient discussed above, the graded increase or decrease of the stoichiometry gradient is not particularly limited and may include any suitable number of "grades" or different stoichiometries. For example, considering the photocathode material as a series of "stoichiometric layers" with each layer representing a different stoichiometry, the photocathode may include any suitable number of stoichiometry layers. As used herein, the term "different stoichiometries" may refer to stoichiometries that are distinguishable by coefficient differences of, for example, at least 0.1 or 0.01. However, embodiments of the present disclosure are not limited thereto, and those having ordinary skill in the art are capable of determining the scale of suitably distinguishable stoichiometries according to the state of the art and the principles described herein. In some embodiments, for example, the stoichiometry gradient may include at least two different stoichiometries, for example at least three or more, at least four or more, or at least five or more different stoichiometries. It is understood also, that while reference is made here to "stoichiometry layers," neither the photocathode nor the stoichiometry gradient is necessarily separated into discrete layers of materials or stoichiometries. Instead, in some embodiments, the stoichiometry of the photocathode material can vary gradually enough that the photocathode material and structure is considered continuous. In some embodiments, however, the photocathode material may be considered a collection of discrete layers, each having a different stoichiometry, thereby creating a graded (and layered) stoichiometric structure.

In some embodiments, the composition of the photocathode material may further include one or more vacancies in its crystal lattice structure. In such embodiments, the vacancy (absence of an atom) is not necessarily or explicitly stated as a component of the chemical formula, but may exist in the composition depending on the stoichiometry and corresponding crystal structure of the material. In these embodiments, the vacancy may be conceptually understood as being equivalent to an element of the empirical formula for the purposes of stoichiometry. As such, references herein to elements included in the empirical formula of the photocathode material (or composition) may refer to the chemical elements explicitly stated therein (e.g., In, Ga, and N in an InGaN empirical formula) as well as any vacancies. Accordingly, the concentration of each type or kind of vacancy may contribute to the stoichiometry gradient in the same manner as the other elements (e.g., the chemical elements in the empirical formula). For example, they may be uniform throughout the photocathode, or may be tuned (or tailored) in the same manner as described above in connection with the chemical elements in order to form a stoichiometry gradient based on the concentration of the vacancy.

In some embodiments, the photocathode material has a ternary composition, i.e., a composition that includes three elements, A, B, and C. In such embodiments, the stoichiometry gradient may be achieved by holding the concentration or stoichiometry of the first element A constant throughout the depth (or thickness) of the photocathode, and varying the concentration or stoichiometry of the second element B to create a stoichiometry gradient of the element B. In some embodiments, the stoichiometry gradient created by varying the concentration of the B element includes a higher concentration of the B element at the emitting surface than at the opposing surface. However, in some embodiments, the opposite is true, and the stoichiometry gradient includes a lower concentration of the B element at the emitting surface than at the opposing surface.

According to some embodiments, the stoichiometry gradient may be achieved by holding the concentration of the A element constant, and varying the concentration of the C element to create a stoichiometry gradient of the element C. In some embodiments, the stoichiometry gradient created by varying the concentration of the C element includes a lower concentration of the C element at the emitting surface than at the opposing surface. However, in some embodiments, the opposite is true, and the stoichiometry gradient includes a higher concentration of the C element at the emitting surface than at the opposing surface.

In some embodiments, the stoichiometry gradient may be achieved by holding the concentration of the A element constant, and varying the concentration of both the B and C elements. For example, in some embodiments, the stoichiometry gradient may be achieved by holding the concentration of the A element constant, varying the concentration of the B element to create a B element gradient including a higher concentration of the B element at the emitting surface than at the opposing surface, and varying the concentration of the C element to create a C element gradient including a lower concentration of the C element at the emitting surface than at the opposing surface. For example, in an example composition including three elements $A_iB_jC_k$, i may be constant while j and k may each increase or decrease in tandem along a common coordinate (e.g., depth, thickness or the z coordinate) toward the emitting surface. Although the concentrations of the B and C elements may be varied in this example, the sum of i+j+k remains constant (e.g., i+j+k=1, although embodiments of the present disclosure are not limited thereto).

Additionally, in some embodiments in which the photocathode material is a ternary composition, the composition of the photocathode material may be substantially binary including the constant element A and one of the other elements B or C (e.g., AB) at one end or surface (e.g., the emitting or opposing surface) of the photocathode (e.g., $A_iB_{j+k}$ in the above example formula), and substantially binary including the constant element A and the other of the remaining elements B and C (e.g., AC) at the opposite end or surface (e.g., the other of the emitting or opposing surface) of the photocathode (e.g., $A_iC_{j+k}$ in the above example formula). For example, in some embodiments, the photocathode material may be substantially binary including the constant (or first) element (A) and the second element (or first variable element; B) at the emitting surface, and substantially binary including the first element (A) and the third element (or second variable element; C) at the opposing surface.

As used herein in the context of these embodiments of ternary composition systems, the term "substantially binary" means that the stoichiometry gradient achieved in the ternary system includes a near zero concentration of one of the three elements of the ternary system (e.g., a near zero concentration of the C element in the portions of the gradient that are AB, and a near zero concentration of the B element in the portions of the gradient that are AC). The term "substantially" in this context is used as a term of approximation and not as a term of degree, and is intended to reflect the difficulty in achieving exact measurements or calculations of the concentration of the near zero element. Additionally, the term "near" in "near zero" is not used as a term of degree, but rather as a term of approximation intended to account for the fact that the concentration of the near zero element may not be exactly zero, but may instead have some positive value that has only a negligible effect, if any effect at all, on the chemical, electrical, physical or other performance of the material or device.

In some embodiments of these ternary systems, the composition of the photocathode material may vary as described above without either of the varied elements (e.g., B or C) reaching a concentration of absolute 0 at either the emitting or opposing surface of the photocathode. Instead, in these embodiments, each of the varied elements (e.g., B and C) may have a positive concentration that is greater than 0, and in some embodiments, greater than near zero, as that term is defined above. According to some embodiments, this configuration yields at least one segment or portion of the photocathode that includes a higher concentration of one of the varied elements (e.g., B) and a lower concentration of the other of the varied elements (e.g., C). For example, in some embodiments, the second element B may have a concentration higher than that of the third element C at the emitting surface, and the third element C may have a concentration higher than that of the second element B at the opposing surface.

In some embodiments, the stoichiometry and bandgap gradients are tunable down to a resolution of about 1 nm. As used herein, "tunable down to a resolution of about 1 nm," refers to the ability to achieve distinct (e.g., measurably or observably different) stoichiometries or bandgap energies at depths within the photocathode that are as small as about 1 nm apart. In some embodiments, for example, the stoichiometry and bandgap gradients are tunable down to a resolution of about 0.5 nm to about 2 nm or about 0.5 nm to about 1.0 nm.

According to some embodiments, the photocathode material may be a Group III-V semiconductor. The Group III material may include any suitable Group III material, for example, boron (B), aluminum (Al), gallium (Ga), indium (In), thallium (Tl), and combinations thereof. The Group V material may include any suitable Group V material, for example, nitrogen (N), phosphorus (P), arsenide (As), antimony (Sb), bismuth (Bi), and combinations thereof.

In some embodiments of ternary III-V materials, the photocathode material may include indium gallium nitride (InGaN), gallium indium arsenide (GaInAs), or gallium indium antimonide (GaInSb).

In some embodiments, the photocathode material may be InGaN. In these systems, the stoichiometry of N may be constant throughout the photocathode (i.e., N may be the A element discussed above in the ABC system), while the amount of In may increase with increasing proximity to the emitting surface (i.e., In may be the B or C element in the ABC system), and the amount of Ga may decrease with increasing proximity to the emitting surface (i.e., Ga may be the other of the B and C elements in the ABC system). In some embodiments, the photocathode material may include a substantially binary InN composition at and/or near the emitting surface and a substantially binary GaN at the opposing surface. However, embodiments of the present disclosure are not limited thereto, and in some example embodiments, the photocathode may include a variable $In_{1-x}Ga_xN$ composition in which $0.5<x<1$ at and/or near the emitting surface, and $0<x<0.5$ at and/or near the opposing surface.

Figure 4:
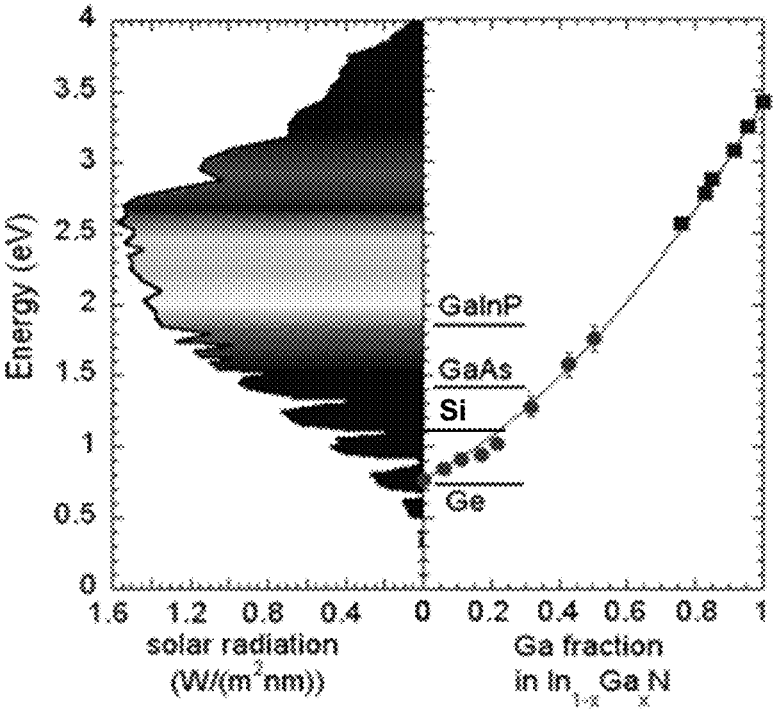
FIG. 4 is a composite graph showing the solar radiation spectrum and the bandgap range for $In_{1-x}Ga_xN$. The left half of the graph shows the distribution of energies emitted by the sun (y-axis, in eV) and the relative flux (x-axis) with respect to energy. The right half of the graph shows the relationship between bandgap energy (y-axis) and composition (Ga fraction, x-axis). The horizontal lines labeled GaInP, GaAs, Si, and Ge denote the fixed (non-tunable)

FIG. 4 is a composite graph showing the solar radiation spectrum and the bandgap range for $In_{1-x}Ga_xN$. The left half of the graph shows the distribution of energies emitted by the sun (y-axis, in eV) and the relative flux (x-axis) with respect to energy. The right half of the graph shows the relationship between bandgap energy (y-axis) and material composition (Ga fraction, x-axis). The horizontal lines labeled GaInP, GaAs, Si, and Ge denote the fixed (un-altered or un-tuned) bandgaps of these benchmark materials. The circle markers correspond to regions of the $In_{1-x}Ga_xN$ material having a larger fraction of In, while the square markers correspond to regions of the $In_{1-x}Ga_xN$ material having a larger fraction of Ga. The comparison shows that the bandgap of this system can be tuned (or varied or tailored) over a range substantially spanning the solar spectrum. FIG. 4 is shown in black and white, however, a color version is available in Wu. J. et al., "Superior radiation resistance of $In_{1-x}Ga_xN$ alloys: Full-solar-spectrum photovoltaic material system", *J. Appl. Phys.,* 2003, 94, 6477, FIG. 1, the entire content of which is incorporated herein by reference.

In some embodiments, the photocathode material may be a semiconducting oxide (oxide semiconductor). For example, the photocathode material may include one or more Group III oxides.

In some embodiments, when the photocathode material is an oxide semiconductor, the material may be gallium indium oxide (GaInO). For example, the stoichiometry of O may be constant throughout the photocathode (i.e., the O may be the A element in the ABC system described above), and the amounts of Ga and In may vary while their total stoichiometry (In+Ga) remains constant (i.e., the Ga and In may be the B and C elements in the ABC system). In some embodiments, the photocathode material may include a substantially binary $Ga_2O_3$ composition at and/or near the emitting surface of the electrode and a substantially binary $In_2O_3$ composition at and/or near the opposing surface of the electrode. In some embodiments, the photocathode material may include a substantially binary $Ga_2O_3$ composition at the emitting surface and a substantially ternary $Ga_{2-y}In_yO_3$ ($y>0$) composition at the opposing surface. However, embodiments of the present disclosure are not limited thereto, and in some example embodiments, the photocathode may include $Ga_{2-y}In_yO_3$ in which $0<y<1$ at the emitting surface, and $1<y<2$ at the opposing surface.

In some embodiments, the photocathode material has strong absorption and high carrier mobility within at least a portion of the entire stoichiometric range, and in some embodiments, the photocathode material has these characteristics throughout the entire stoichiometric range. In addition, in some embodiments, the photocathode material may include any suitable material having high temperature tolerance, chemical inertness, and radiation resistance. Those having ordinary skill in the art are capable of identifying and selecting suitable materials for the photocathode based on the concepts described herein and the intended application of the photocathode.

In some embodiments, in addition to the stoichiometry and bandgap gradients, the photocathode material may also include a gradual or graded change in one or more characteristics of the crystal structure, thereby resulting in a crystal gradient (also referred to herein as a structure or crystal structure gradient).

In some embodiments, for example when the photocathode material includes two elements that increase/decrease in concentration in tandem, the two elements may occupy the same site in the crystal lattice. Accordingly, the crystal lattice may include a higher concentration of a first element (compared to the second element) at that lattice site in a unit cell at one surface (i.e., the emitting or opposing surface) of the photocathode, and a higher concentration of the second element (compared to the first element) at that same lattice site in a unit cell at the opposite surface (i.e., the other of the emitting surface or opposing surface) of the photocathode.

As another example, in some embodiments, one or more elements of the photocathode material (e.g., A, AC or AB in the ABC system described above) may form a consistent lattice structure such that another of the elements of the photocathode material (e.g., B or C in the ABC system) is intercalated or may consistently occupy an interstitial site within that lattice structure at an increasing number of sites as the concentration of the (B or C) element that occupies the interstitial site is increased. For example, the interstitial site may be vacant at one end of the crystal structure gradient, and filled (e.g., with either B or C) at the other end of the crystal structure gradient.

However, the photocathode material should have single crystalline or substantially single crystalline characteristics throughout the crystal gradient. That is, the grain (domain) size of the material should be roughly or substantially on the same order as the photocathode thickness. Grain boundaries between crystals serve as scattering interfaces that may reduce the number of electrons that reach the emitting surface, thereby decreasing the quantum efficiency of the photocathode. When the photocathode structure has substantially single crystalline characteristics, scattering of electrons within the photocathode may be reduced. Accordingly, the single crystalline or substantially single crystalline nature should remain constant over the crystal gradient. In some embodiments, the space group of the crystal structure remains constant or substantially constant over the crystal gradient. In some embodiments, the photocathode material does not include any grain boundaries or dislocations (or includes substantially no grain boundaries or dislocations) in a direction parallel to the emitting surface of the photocathode.

In addition, when compositions along the stoichiometry or bandgap gradient do not form crystalline substances, but instead form amorphous substances, the amorphous regions may strongly increase electron scattering such that the quantum efficiency is heavily degraded. Accordingly, in some embodiments, the composition of the photocathode material is selected so that all combinations (ratios) of elements along the stoichiometry and/or bandgap gradient are capable of achieving a crystalline structure.

In some embodiments, when the photocathode material is InGaN, the GaN forms a superstructure having a Wurtzite crystal structure (hexagonal) into which varying amounts of In are intercalated (for example, between Ga and N panes) and corresponding amounts of Ga are removed. The decrease in bandgap with respect to pure GaN is correlated with an increasing amount (concentration) of intercalated indium. In some embodiments, the bandgap may range from about 0.7 eV to about 3.4 eV (depending on the specific composition at the point of measurement).

In some embodiments, when the photocathode material is GaInO, the GaO forms a superstructure having a spinel-type structure into which varying amounts of $In^{3+}$ are intercalated and corresponding amounts of Ga are removed. In some embodiments, the bandgap may range from about 3.5 eV to about 4.9 eV (depending on the specific composition at the point of measurement).

The thickness of the photocathode is not particularly limited, and may be any thickness suitable for the desired or intended photoemission application. In some embodiments, the photocathode may have a thickness of about 50 nm to about 1 μm, for example, 100 nm to about 800 nm, and in some embodiments, 250 nm to about 600 nm.

In some embodiments, the photocathode further includes a substrate next to the opposing surface in order to provide mechanical support. The substrate serves as a physical support for the photocathode, and may be formed of any suitable solid material as long as it is compatible with the photocathode environment (e.g., high vacuum) and structure. For example, the substrate may include a glass, a metal, an alloy, certain polymer plastics (such as PVDF, PTFE, etc.), a ceramic, a crystalline material, or mixtures thereof.

As used herein, the term "glass" may refer to a non-crystalline amorphous solid that exhibits a glass transition when heated; for example, silica glasses such as fused quartz, sodium borosilicate, aluminosilicate, and/or the like.

As used herein, the term "ceramic" may refer to an inorganic and non-metallic solid comprising atoms held together in networks of ionic and covalent bonds; for example, silicon carbide, silicon nitride, zirconium oxide, and the like.

As used herein, the term "crystalline material" may refer to an inorganic and non-metallic solid (such as a ceramic, metalloid, or the like) in which the component atoms are held together via ionic bonds and arranged with long-range periodicity; for example, quartz, silicon, anatase, rutile, etc. In some embodiments, the substrate may be formed of quartz, glass, or silicon.

With respect to structure, in some embodiments, when the photocathode is epitaxially deposited (as described below), the substrate is a crystalline material. The crystalline material acts as a template that encourages crystal growth of the material to be deposited.

In some embodiments, the photocathode may be formed without an underlying substrate layer. For example, the thickness of the photocathode on its own may be large enough to have adequate or suitable mechanical stability, e.g., may act as its own substrate. In some embodiments, when the photocathode is formed without an underlying substrate layer, the thickness of the photocathode may be substantially similar to the thickness of the substrate layer described above. However, embodiments of the present disclosure are not limited thereto, and those of ordinary skill in the art are capable of selecting a layer thickness and suitable methods of forming the layer, according to the principles described herein and the intended photoemission application.

In some embodiments, the substrate may include a conductive material in order to improve electron emission. Without being limited to any particular mechanism or theory, it is believed that the conductive material may aid in replenishing emitted electrons, either by serving as an electron reservoir or by forming a conductive material-semiconductor junction that alters the carrier density distribution of the photoemission layer. Non-limiting examples of such conductive material may include a metal, an alloy, or a conductive metal oxide. When the conductive material is a metal, the metal may include any suitable alkaline earth metal, transition metal, or post-transition metal. For example, the metal may include gold (Au), silver (Ag), aluminum (Al), indium (In), magnesium (Mg), calcium (Ca), or zirconium (Zr). When the conductive material is an alloy, the alloy may include a suitable steel or may combine two or more of the above metals. When the conductive material is a metal oxide, the metal oxide may include any suitable conductive oxide of a metal described above, for example, ITO, IZO, or the like.

In some embodiments, the substrate may have a single layer structure, in which the single layer is formed of one of the above materials. In some embodiments, the substrate may have a multi-layer structure, in which adjacent layers are formed of the same or different materials. For example, the substrate may include a base layer and a conductive layer on the base layer, where the base layer has the function of physically supporting and protecting the other layers from mechanical stress, and the conductive layer has the function of improving electron emission, as described above. In some embodiments, for example, the base layer may include a durable material (such as glass, quartz, etc.), and the conductive layer may include a conductive material (such as gold). In some embodiments, the substrate may further include an adhesion layer between the conductive layer and the base layer in order to prevent or reduce delamination of the conductive layer from the base layer. However, embodiments of the present disclosure are not limited thereto, and the substrate may suitably include any number of layers in any configuration.

The thickness of each layer of the substrate is not particularly limited, and may be selected according to the desired overall thickness, cost, etc. In some embodiments, when the substrate includes a conductive layer on a non-conductive base layer where the conductive layer is applied as a thin film, the thickness of the conductive layer may be about 5 nm to about 250 nm, for example, about 10 nm to about 200 nm, or about 25 nm to about 150 nm. In some embodiments, the adhesion layer may have a thickness of about 2 nm to 25 nm, for example, 5 nm to 15 nm. In some embodiments, the substrate may include a base layer made of quartz and a conductive layer including Au with a thickness of about 25 nm to about 150 nm. In some embodiments, the substrate may include a base layer made of quartz, an adhesion layer including 10 nm of Cr, and a conductive layer including 200 nm of Au.

In some embodiments, the photocathode may further include a nanostructured resonant tunneling transmission layer on the photoemission layer (i.e., the photocathode material) in order to further tune the emittance of the resultant emitted electron beam. The resonant tunneling transmission layer may have a superlattice structure (e.g., may be an ordered system) having long-range periodicity and effectively forming a lattice of separated quantum wells. When electrons emitted by the photoemission layer pass through the resonant tunneling transmission layer and encounter the multiple tunneling barriers of the separated quantum wells, photoemission from the resonant tunneling transmission layer is permitted only at discrete energy levels corresponding to the quantum tunneling resonances. As used herein, the term "quantum tunneling" is used in its art-recognized sense to refer to the quantum mechanical phenomenon by which a particle on the quantum scale is able to move past an energy potential barrier. As a result, the resonant tunneling transmission layer further "filters" and restricts the energy distribution of the photoemitted electron beam, thus further decreasing its emittance without affecting the quantum efficiency.

The resonant tunneling transmission layer may have any suitable thickness. For example, in some embodiments, the resonant tunneling transmission layer may have a thickness of about 2 to about 20 atomic layers, and in some embodiments, about 2 to about 10 atomic layers.

The resonant tunneling transmission layer may be formed from any suitable material. For example, in some embodiments, the resonant tunneling transmission layer may include carbon graphene, white graphene (e.g., hexagonal boron nitride or h-BN), and/or similar materials forming a superlattice or having a two dimensional periodic structure. However, embodiments of the present disclosure are not limited thereto, and those of ordinary skill in the art are capable of identifying and selecting appropriate materials for the resonant tunneling transmission layer.

According to one or more embodiments of the present disclosure, a method of fabricating a photocathode having a tunable bandgap includes: computing a transport energetics profile for the photocathode; computing a complementary bandgap profile based on the transport energetics profile; and depositing a composition to create the material having the bandgap gradient according to the complementary bandgap profile.

The transport energetics profile of the photocathode will depend on the composition of the photocathode material, which may be selected according to the principles described herein. For example, the photocathode material may include two or more elements, one of more of which elements has a stoichiometry gradient between the emitting and opposing faces of the photocathode. The photocathode material may be single crystalline throughout that stoichiometry gradient (e.g., have a grain size that is substantially the same size as the photocathode thickness, without any (or with substantially no) amorphous regions). In some embodiments, the photocathode material may be a III-V material system, and in some embodiments, may be InGaN. In some embodiments, the photocathode material may be an oxide semiconductor, and in some embodiments, may be GaInO.

In some embodiments, computing a transport energetics profile for the photocathode may be achieved utilizing a Monte Carlo-based simulation method, which predicts how many scattering events an electron will encounter, on average, during transport to the emitting surface from a given excitation (or generation) position in a particular material system (i.e., Step 2 of the electron photoemission mechanism discussed herein). The methodology is similar to the particle-in-cell (PIC) methodology, and conceptually includes: dividing the material to be modeled into a series of finite elements; formulating a set of rules governing the passage of the electron from one element to another with respect to the energetic allowability and probability of the passage, and computing the statistical probability of a given electron's passage across the set of elements (e.g., through the photocathode) along with its resulting energy/momentum. The methodology is based on a Moments model of photoemission that is specifically adapted to semiconductor materials, and assumes an isotropic distribution of photoexcited electrons, isotropic scattering, and that inelastic scattering depends only on the electron's energy. As used herein, the term "scattering profile" refers to the range of transport energetics experienced by electrons originating from different depths within the photocathode.

Figure 5:
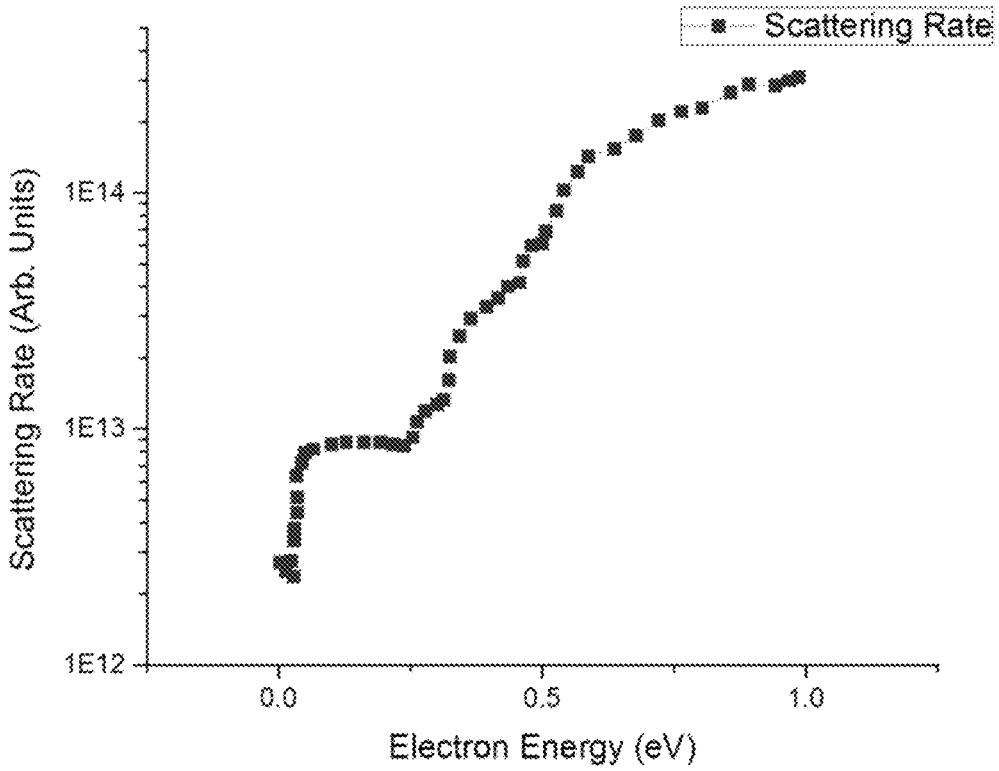
FIG. 5 is a graph showing the computed electron scattering rate as a function of electron energy in a generic semiconductor material.

FIG. 5 is a graph showing the computed electron scattering rate as a function of electron energy in a generic semiconductor material. This basic correlation can be combined with the electron mobility for a given material to calculate the energy loss (e.g., transport energetics) for an electron generated at a given depth (z) and initial excitation energy ($\hbar w$).

In some embodiments, the modeling output includes a simulated beam shape profile, showing the pulse shape, density, and range of emitted electron energies.

In some embodiments, computing a complementary bandgap profile based on the transport energetics profile may be achieved by calculating the difference between a constant energy value larger than the maximum scattering energy, and the scattering energy profile. The calculation may be done continuously over the range, or for selected points within the range.

In some embodiments, an initial bandgap energy profile of the material being modeled (e.g., with respect to depth) can be generated and then iteratively tuned so that changes in the bandgap energy profile can be correlated with changes in the beam shape profile, and/or the bandgap energy profile and beam shape profile can be optimized for reduced emittance.

The resulting bandgap energy profile used to produce an electron beam with reduced emittance can then be correlated with known photocathode compositions (stoichiometries) capable of producing that range of bandgaps. The stoichiometries can then be deposited to match the bandgap energy profile.

In some embodiments, the computational methods may be similar to those described in Jensen, K. L., et al. "Delayed Photo-Emission Model for Beam Optics Codes", *J. Vac. Sci. Tech. B,* 2016, 35(2), 02C102, the entire content of each of which is incorporated herein by reference.

In some embodiments, depositing the composition may be achieved (e.g., the photocathode material may be deposited) using an epitaxial method, such as vapor phase epitaxy (VPE), molecular beam epitaxy (MBE), liquid phase epitaxy (LPE), or solid phase epitaxy (SPE).

In some embodiments, deposition may be achieved utilizing the Energetic Neutral Atom Beam Lithograph & Epitaxy (ENABLE) system, described in U.S. Pat. No. 738,376, the entire content of which is incorporated herein by reference. The ENABLE method was developed at Los Alamos National Laboratory (LANL) and uses an energetic beam of neutral nitrogen (N) and/or oxygen (O) atoms having tunable kinetic energies between 1 to 5 eV as the active growth species. The use of this kinetic energy to overcome reaction barriers eliminates the need for high substrate temperatures to activate the desired surface chemistry. The high kinetic energy and high reactivity of the N and/or O atoms allows rapid, low-temperature growth of device quality metal nitride and metal oxide films on substrates that are simultaneously exposed to energetic N and/or O atoms and any suitable evaporated metal flux in a clean molecular beam epitaxy (MBE) environment.

Using the ENABLE method, the stoichiometry of the deposited film at any given point during fabrication may be configured by selecting a suitable delivery rate of one or more atomic fluxes and/or energetic atoms to the surface of the substrate or photocathode. The delivery rate of the atomic fluxes and/or energetic atoms should be adjusted to account for competing rate equations for the reaction of the atoms to yield the desired stoichiometric product. For example, the atomic flux of one element may be set lower than the others so that the reaction rate is limited by that element.

The atomic fluxes may be delivered by, for example, e-beam and thermal evaporation. When the atomic fluxes are subject to evaporative losses, care should be taken to account for the loss in flux when attempting to produce a material having a particular stoichiometry.

In some embodiments, the delivery rate of one atomic flux and/or energetic atoms may be configured to vary over time and deposition point, while the delivery rates of the other atomic fluxes and/or energetic atoms remain constant. However, embodiments of the present disclosure are not limited thereto, and those having ordinary skill in the art are capable of selecting suitable delivery rate combinations according to the principles described herein.

In some embodiments, for example, when the semiconductor material includes InGaN, the Ga metal flux may be fixed (constant), the In metal flux rate may be secondarily set to vary according to the position within the depth (or thickness) of photocathode, and the arrival rate of nitrogen atoms may be selected so that the rate of InGaN formation reaction depends on the rate of N delivery. However, embodiments of the present disclosure are not limited thereto, and those having ordinary skill in the art are capable of suitably modifying the conditions used for deposition according to the principles described herein and the desired photocathode structure and composition.

In some embodiments, for example, when the photocathode material includes GaInO, the Ga metal flux may be fixed (constant), the In metal flux rate may be secondarily set to vary according to position within the depth (or thickness) of the photocathode, and the arrival rate of oxygen atoms may be selected so that the rate of GaInO formation reaction depends on the rate of O delivery. However, embodiments of the present disclosure are not limited thereto, and those having ordinary skill in the art are capable of suitably modifying the conditions used for deposition according to the principles described herein and the desired photocathode structure and composition.

In some embodiments, the delivery rate of the energetic atoms may be about $10^{14}$ atoms/cm$^2$*sec to about $10^{18}$ atoms/cm$^2$*sec. The delivery rate of the one or more atomic fluxes may be about 0.1 μm/hr to about 10 μm/hr (e.g., the average rate of vertical growth over the surface of the electrode), and in some embodiments, 0.1 μm/hr to about 4.0 μm/hr.

The photocathode material may be deposited on any suitable substrate material, including the ones described herein.

Further, the temperature of the substrate may be adjusted in order to promote the formation of more highly aligned crystals. The temperature of the substrate may be selected according to the growth requirements of the specific photocathode material being deposited. In some embodiments, the temperature of the substrate may be about 20° C. to about 700° C. For example, when the photocathode material includes InGaN, the substrate may be heated to a temperature of about 300° C. to about 500° C., or in some embodiments, about 400° C. to about 500° C.

In some embodiments, the above methods of fabricating a photocathode may result in a photocathode having a bandgap, stoichiometry and/or crystal structure resolution of about 1 nm, for example, 0.5 nm to about 1.5 nm.

The methods used to deposit the graded photocathode material via ENABLE may be similar to those described in Miller, N., et al., "Low-temperature grown compositionally graded InGaN films", *Phys. Stat. Sol. C,* 2008, 5(6), 1866-1869, the entire content of which is incorporated herein by reference.

According to one or more embodiments of the present disclosure, a vacuum electronic device includes a photocathode, an anode, and a light source. The photocathode and anode 4 configured to be under vacuum and the light source is directed toward the photocathode.

The anode and light source are not particularly limited, and may be any anode or light source available in the related art. The light source may have any suitable customized spatial intensity profile and/or temporal profile. In some embodiments, the light source may be pulsed.

According to one or more embodiments of the present disclosure, a method of generating an electron beam with low emittance includes: computing a transport energetics profile for a photocathode; computing a complementary bandgap profile based on the transport energetics profile; depositing a composition to create a photocathode material having a bandgap gradient based on the complementary bandgap profile; combining the photocathode with an anode under a high vacuum environment; biasing the photocathode toward a negative voltage; and irradiating the photocathode with a light source.

Computing a transport energetics profile for the photocathode, computing a complementary bandgap profile based on the transport energetics profile, and depositing a composition to create the material having the bandgap gradient may be the same as or similar to those described above in connection with fabricating the photocathode.

Combining the photocathode with an anode under a high vacuum environment may be carried out using any suitable anode and high vacuum environment available in the art. For example, the anode may be a Faraday cup and the high vacuum environment may be produced using a sealable vacuum chamber including windows for optical access.

Biasing the photocathode toward a negative voltage may be achieved using standard practices in the related art or similar practices, and may be carried out using any suitable voltage. For example, the photocathode may be biased to about −10 kV to about −30 kV, or in some embodiments about −20 kV relative to the anode.

Irradiating the photocathode with a light source may be achieved using standard practices in the related art or similar practices, and may be carried out using any suitable light source. For example, the irradiation may be carried out using pulsed laser excitation.

While certain exemplary embodiments of the present disclosure have been illustrated and described, those of ordinary skill in the art will recognize that various changes and modifications can be made to the described embodiments without departing from the spirit and scope of the present invention, and equivalents thereof, as defined in the claims that follow this description. For example, although certain components may have been described in the singular, i.e., "a" photocathode, "an" atomic flux, and the like, one or more of these components in any combination can be used according to the present disclosure.

Also, although certain embodiments have been described as "comprising" or "including" the specified components, embodiments "consisting essentially of" or "consisting of" the listed components are also within the scope of this disclosure. For example, while embodiments of the present invention are described as comprising selecting a semiconductor material for the photocathode; computing a bandgap profile model for the semiconductor material in the photocathode; and depositing a composition to create the material having the bandgap gradient according to the complementary bandgap profile, embodiments consisting essentially of or consisting of these actions are also within the scope of this disclosure. Accordingly, for example, a method of generating an electron beam may consist essentially of selecting a semiconductor material for the photocathode; computing a bandgap profile model for the semiconductor material in the photocathode; and depositing a composition to create the material having the bandgap gradient according to the complementary bandgap profile. In this context, "consisting essentially of" means that any additional components or process actions will not materially affect the outcome produced by the method, including the performance of the resulting photocathode.

As used herein, unless otherwise expressly specified, all numbers such as those expressing values, ranges, amounts or percentages may be read as if prefaced by the word "about," even if the term does not expressly appear. Further, the word "about" is used as a term of approximation, and not as a term of degree, and reflects the penumbra of variation associated with measurement, significant figures, and interchangeability, all as understood by a person having ordinary skill in the art to which this disclosure pertains. Any numerical range recited herein is intended to include all sub-ranges subsumed therein. Plural encompasses singular and vice versa. For example, while the present disclosure may describe "a" gradient or "an" element, a mixture of such gradients or elements can be used. When ranges are given, any endpoints of those ranges and/or numbers within those ranges can be combined within the scope of the present disclosure. The terms "including" and like terms mean "including but not limited to," unless specified to the contrary. Further, as used herein, the term "substantially" is used as a term of approximation and not as a term of degree, and is intended to account for normal variations and deviations in the measurement or assessment of various parameters of the complexes and compositions (e.g., in the description of physical or chemical properties of various components and in the description of amounts of various components).

Notwithstanding that the numerical ranges and parameters set forth herein may be approximations, numerical values set forth in the Examples are reported as precisely as is practical. Any numerical value, however, inherently contains certain errors necessarily resulting from the standard variation found in their respective testing measurements. The word "comprising" and variations thereof as used in this description and in the claims do not limit the disclosure to exclude any variants or additions.

What is claimed is:

1. A photocathode, the photocathode comprising an emitting surface and an opposing surface opposite the emitting surface, the emitting surface and the opposing surface being separated from each other by a depth of the photocathode, the photocathode comprising a material having a bandgap, the bandgap having a bandgap energy configured to vary within the material along the depth of the photocathode, such that the bandgap energy varies as a gradient along the depth of the photocathode, and a sum of the bandgap energy and electron transport energetics is constant throughout the depth of the photocathode.

2. The photocathode of claim 1, wherein the bandgap gradient includes a lower bandgap energy at the opposing surface and a higher bandgap energy at the emitting surface.

3. The photocathode of claim 1, wherein the material having the bandgap comprises a stoichiometry that varies as a gradient along the depth of the photocathode, and the stoichiometry along the depth of the photocathode dictates the bandgap energy along the depth of the photocathode.

4. The photocathode of claim 1, wherein the material having the bandgap is a III-V semiconductor material.

5. The photocathode of claim 1, wherein the material having the bandgap is an oxide semiconductor material.

6. The photocathode of claim 3, wherein the material having the bandgap is a ternary semiconductor material comprising a first element, a second element, and a third element;

the first element having a constant concentration throughout the depth of the photocathode;

the second element having a concentration higher than that of the third element at the emitting surface; and the third element having a concentration higher than that of the second element at the opposing surface.

7. The photocathode of claim 6, wherein the material having the bandgap substantially comprises the first element and the second element at the emitting surface, and substantially comprises the first element and the third element at the opposing surface.

8. The photocathode of claim 6, wherein at least one of the first, second, and third elements is located in an interstitial position.

9. The photocathode of claim 4, wherein the material is InGaN, GaInSb, or GaInAs.

10. The photocathode of claim 9, wherein the material is InGaN.

11. The photocathode of claim 5, wherein the material is GaInO.

12. The photocathode of claim 1, wherein the material having the bandgap has a grain size as large as the depth of the photocathode.

13. The photocathode of claim 3, wherein the bandgap has a resolution of about 0.5 nm to about 1.5 nm.

14. A method of fabricating the photocathode of claim 1, the method comprising:

computing a transport energetics profile for the photocathode;

computing a complementary bandgap profile based on the transport energetics profile; and depositing a composition according to the complementary bandgap profile.

15. A vacuum electronic device comprising:

the photocathode of claim 1;

an anode; and a light source, wherein the photocathode and anode are configured to be under vacuum and the light source is directed toward the photocathode.

16. A method of generating a low-emittance electron beam, the method comprising:

computing a depth profile of electron transport energetics for a photocathode comprising a material having a bandgap;

computing a complementary depth profile of bandgap energy for the photocathode, wherein a sum of the electron transport energetics and bandgap energy is constant throughout the depth of the photocathode;

depositing elements comprised in the material having a bandgap to form a stoichiometry gradient along the depth of the photocathode to create an experimental depth profile of bandgap energy that matches the computed depth profile of bandgap energy;

combining the photocathode with an anode under a high vacuum environment;

biasing the photocathode toward a negative voltage; and irradiating the photocathode with a light source.

* * * * *